US006655760B1

(12) United States Patent
Sakata et al.

(10) Patent No.: US 6,655,760 B1
(45) Date of Patent: Dec. 2, 2003

(54) COLD STORAGE

(75) Inventors: Yasushi Sakata, Gunma (JP); Yasuhide Watanabe, Gunma (JP); Kazuhiko Okazaki, Saitama (JP); Toshimi Hosokawa, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/582,506

(22) PCT Filed: Oct. 26, 1999

(86) PCT No.: PCT/JP99/05897

§ 371 (c)(1),
(2), (4) Date: Jun. 26, 2000

(87) PCT Pub. No.: WO00/25073

PCT Pub. Date: May 4, 2000

(30) Foreign Application Priority Data

Oct. 26, 1998 (JP) ..... 10-304029

(51) Int. Cl.[7] ..... A47F 3/04
(52) U.S. Cl. ..... 312/116; 312/139.2
(58) Field of Search ..... 312/116, 138.1, 312/139.2, 401, 405, 326, 140, 400, 409; 62/265; 49/501, 504; 52/204.5, 656.2, 656.4, 656.9

(56) References Cited

U.S. PATENT DOCUMENTS 288,427 A * 11/1883 Gray ..... 312/405
2,192,519 A * 3/1940 King ..... 312/139.2 X
2,198,436 A * 4/1940 Hoffman ..... 312/139.2
2,325,263 A * 7/1943 Mcmillan ..... 312/139.2 X
2,345,792 A * 4/1944 Cann ..... 312/400 X
3,815,285 A * 6/1974 Kuyper ..... 49/501
RE31,536 E * 3/1984 Holdiman et al. ..... 49/504 X
4,546,585 A * 10/1985 Governale ..... 52/309.11
5,363,611 A * 11/1994 Richardson et al. ..... 312/116

FOREIGN PATENT DOCUMENTS

| | | | | |
|---|---|---|---|---|
| EP | 418461 | * | 3/1991 | ..... 312/116 |
| JP | 48-53295 U | | 7/1973 | |
| JP | 48-34018 Y1 | | 10/1973 | |
| JP | 52-162563 U | | 12/1977 | |
| JP | 4-32484 U | | 3/1982 | |
| JP | 1-88386 U | | 6/1989 | |
| JP | 5-69290 U | | 9/1993 | |

* cited by examiner

*Primary Examiner*—James O. Hansen
(74) *Attorney, Agent, or Firm*—Darby & Darby

(57) ABSTRACT

There is disclosed a cold storage which improves a door insulating performance, and which is preferable particularly for low-temperature insulation of chemicals, and the like. A low-temperature insulating showcase is formed by openably closing a storage chamber opening constituted in an insulation box by a door, the door is constituted of a transparent panel and a see-through composite layer glass, and a panel is detachably attached to the storage chamber side of the composite layer glass.

10 Claims, 10 Drawing Sheets

COLD STORAGE

TECHNICAL FIELD

The present invention relates to a cold storage preferable for uses such as the cold preservation of chemicals, for example, in hospitals, research facilities, and the like.

BACKGROUND ART

Various chemicals have heretofore been used in hospitals and research facilities, and particularly chemicals requiring cold preservation have been contained and kept in a showcase for low-temperature insulation (cold storage) as disclosed, for example, in Japanese Patent Application Laid-Open No. 178510/1996. A conventional low-temperature insulating showcase 100 will next be described with reference to FIGS. 10 and 11.

In the low-temperature insulating showcase 100, a main body is constituted by an insulation box 102 opened in a front face, and a storage chamber 103 for containing chemicals, and the-like is constituted in the insulation box 102. A machine chamber 106 for installing a compressor 104 of a cooling device, and the like is constituted under the insulation box 102, and a cooler (not shown) also constituting the cooling device is disposed inside the storage chamber 103. Moreover, a plurality of shelves 107 for laying thereon chemicals, and the like are extended in the storage chamber 103.

Moreover, the front face opening of the storage chamber 103 is openably closed by two sliding type doors 108, 109. In this case, each of the doors 108, 109 is constituted by placing a transparent composite layer glass 112 in a sash 111 formed by extruding/molding a hard synthetic resin, attached between upper and lower rails 113, 114 attached to upper and lower opening edges of the insulation box 102 and extended to the left and right, and structured to move to the left and right and open/close the opening in a sliding system.

The cold air subjected to heat exchange with the cooler of the cooling device is circulated by a blower (not shown) in the storage chamber 103 closed by the doors 108, 109, and maintained in a refrigeration temperature of +2° C. to +14° C. suitable for the low-temperature insulation of chemicals, and the like.

Since the doors 108, 109 of the conventional low-temperature insulating showcase 100 are structured only of the peripheral hard resin sash 111 and composite layer glass 112 as described above, the entire insulating performance is deteriorated, and humidity in outside air causes dew condensation and adheres to the surfaces of the sash 111 and composite layer glass 112. Therefore, the visibility of the outside is deteriorated, or there is a problem that user's clothes and peripheral floor face are contaminated/damaged.

Moreover, since the low insulating performance adversely affects the cooling ability of the low-temperature insulating showcase 100, energy saving is inhibited, and in the worst case there is a danger that the properties of the inside chemicals are changed by the temperature rise in the storage chamber 103. Furthermore, since the composite layer glass 112 is positioned immediately before the shelves 107 . . . , there occurs a disadvantage that when the chemicals on the shelves 107 . . . drop by some vibration, and the like, the chemicals hit the composite layer glass 112 and break.

Particularly, since the inside of the storage chamber 103 is visible from the outside through the composite layer glass 112, there is a problem that a danger of robbery is rather increased when dangerous drugs are contained inside.

The present invention has been developed to solve the conventional technical problem, and provides a cold storage which improves a door insulating performance and which is preferable particularly for the low-temperature insulation of chemicals, and the like.

DISCLOSURE OF THE INVENTION

According to the present invention there is provided a cold storage in which a storage chamber opening constituted in an insulation box is openably closed by a door, the door is constituted of an insulation wall and a see-through transparent wall, and a panel is detachably attached on the storage chamber side of the transparent wall.

According to the present invention, since in the cold storage formed by openably closing the storage chamber opening constituted in the insulation box by the door, the door is constituted of the insulation wall and the see-through transparent wall, the proportion of the transparent wall to the entire door is reduced, the other part forms the insulation wall, and the insulating performance of the door itself is enhanced. Particularly, since the panel is detachably attached on the storage chamber side of the transparent wall, an insulation space is formed between the transparent wall and the panel.

Therefore, the door insulating performance is further enhanced, the occurrence of dew condensation is effectively inhibited, and the contribution to cooling performance improvement and energy saving can also be realized. Moreover, by the presence of the panel on the storage chamber side of the transparent wall, even when contained articles fall toward the door, the transparent wall is protected by the panel, and the breakage of the transparent wall can be avoided beforehand.

Moreover, the above-described effect can be achieved by forming the panel to be transparent without deteriorating the visibility inside the storage chamber, the storage chamber can be used as a cold/dark chamber by replacing the panel with a light screen color panel and setting the inside of the storage chamber to be invisible, and safety can also be enhanced.

Furthermore, according to the present invention there is provided a chemicals cold storage in which a storage chamber opening constituted in an insulation box is openably closed by a door, and the door is a sliding type door constituted of an insulation wall and a see-through transparent wall.

According to the present invention, since in the chemicals cold storage formed by openably closing the storage chamber opening constituted in the insulation box by the door, the door is constituted as the sliding type door of the insulation wall and see-through transparent wall, the proportion of the transparent wall to the entire door is reduced, the other part forms the insulation wall, and the insulating performance of the door itself is enhanced. Therefore, the occurrence of dew condensation to the door can effectively be inhibited, the contribution to cooling performance improvement and energy saving can also be made, and a preferable showcase for low-temperature insulation of chemicals is formed.

Particularly, since this is achieved by the sliding type door, the door can be opened/closed without any problem even in the installation environment of the cold storage in which there is no space for rotating the door.

Still furthermore, for the cold storage of the present invention, in the above-described invention the insulation wall is constituted of a plurality of insulation panels fixed inside a door main body, and the bond faces of the respective insulation panels are molded in a staircase shape and mutually bonded.

According to this invention, in addition to the above-described invention, since the insulation wall is constituted of a plurality of insulation panels fixed inside the door main body, and the bond faces of the respective insulation panels are molded in the staircase shape and mutually bonded, the mutual bond area of the insulation panels is enlarged, and the bond strength is remarkably enhanced. This can remarkably improve the strength of the entire door in which the insulation panels are used. Particularly, the deterioration of the insulating performance in the bond part can be minimized by lengthening the movement distance of the heat conducted in the bond face.

BEST MODE FOR CARRYING OUT THE INVENTION

Figure 1:
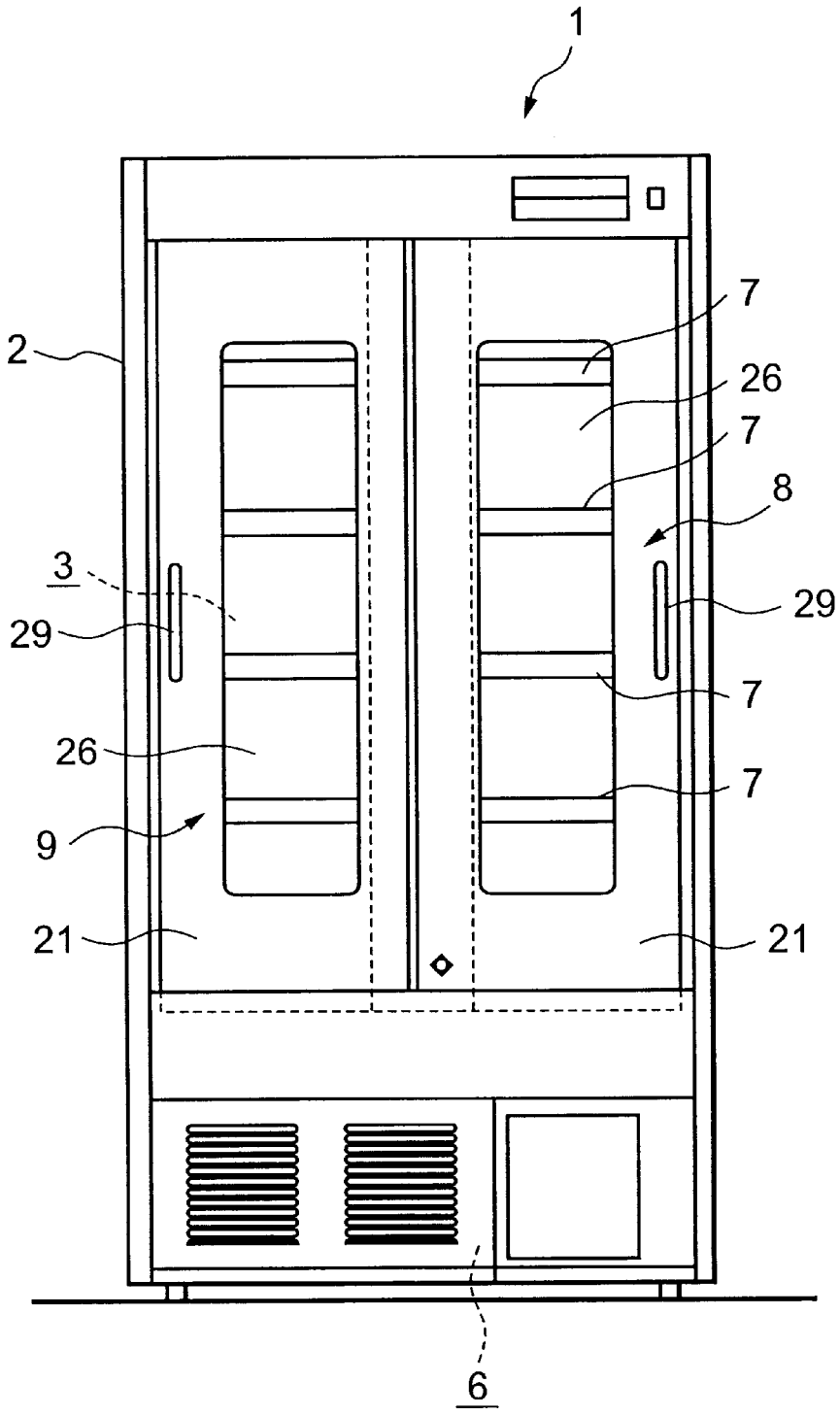
FIG. 1 is a front view of a low-temperature insulating showcase showing an embodiment of a cold storage of the present invention.
Figure 2:
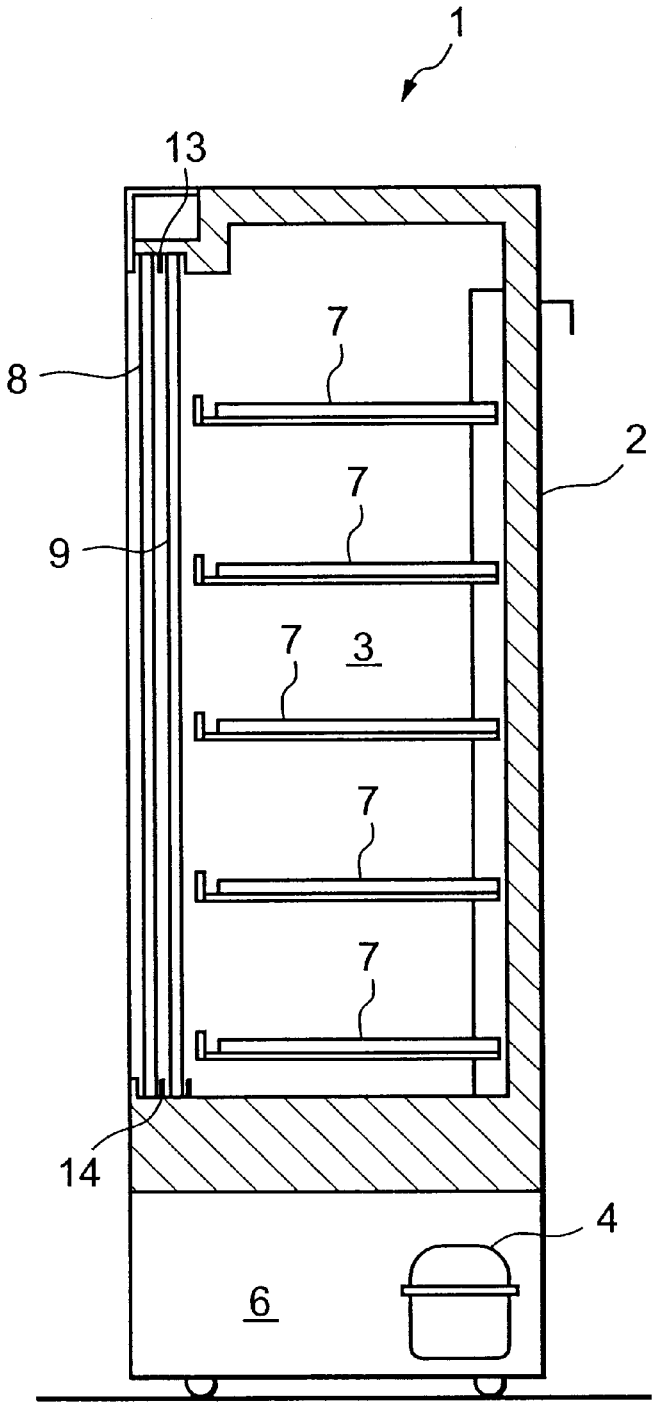
FIG. 2 is a longitudinally sectional side view of the low-temperature insulating showcase of FIG. 1.
Figure 3:
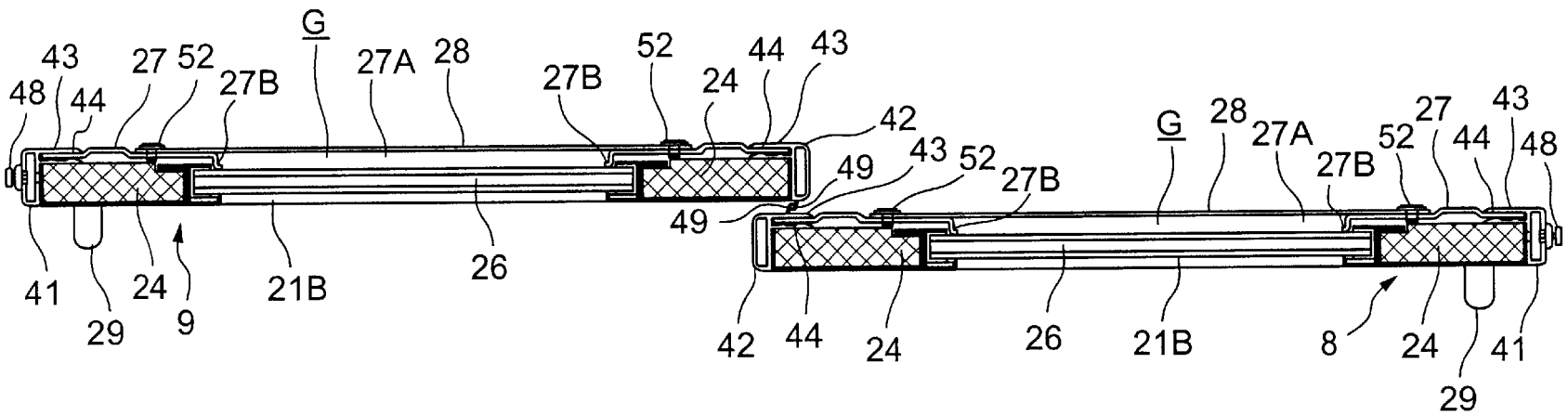
FIG. 3 is a sectional plan view of a door in the low-temperature insulating showcase of FIG. 1.
Figure 4:
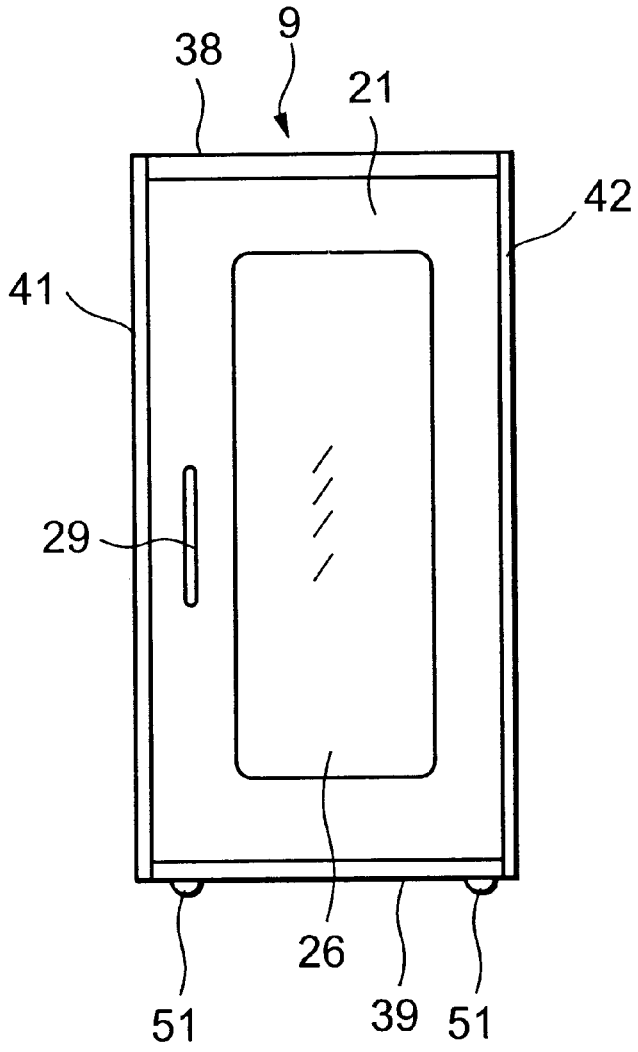
FIG. 4 is a front view of the door (one side) of the low-temperature insulating showcase of FIG. 1.
Figure 5:
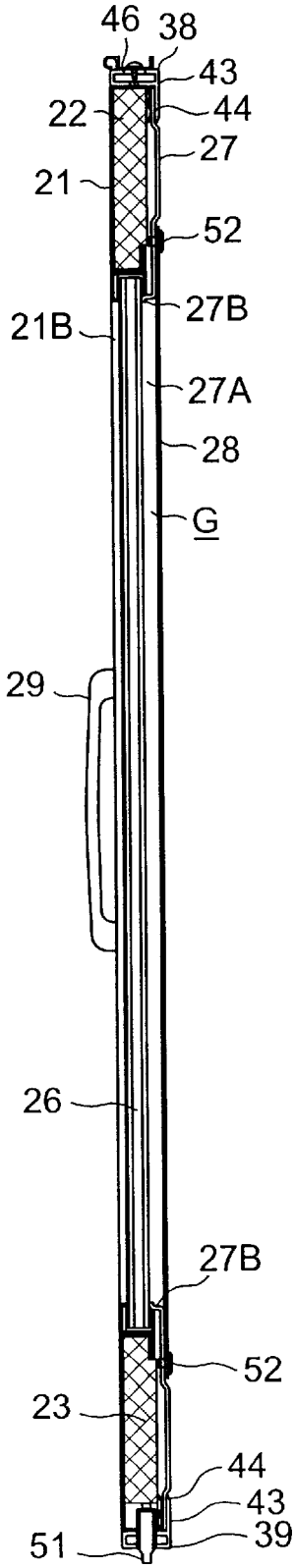
FIG. 5 is a longitudinally sectional side view of the door of FIG. 4.

A mode for carrying out the present invention will be described hereinafter in detail with reference to the drawings. FIG. 1 is a front view of a chemicals low-temperature insulating showcase 1 as an embodiment of a cold storage of the present invention, and FIG. 2 is a longitudinally sectional side view thereof. The low-temperature insulating showcase 1 of the embodiment is used for preserving chemicals, for example, in hospitals and research facilities, and a main body is constituted by an insulation box 2 opened in a front face.

A storage chamber 3 for containing chemicals, and the like is constituted in the insulation box 2, a machine chamber 6 for installing a compressor 4 of a cooling device, and the like is constituted under the insulation box 2, and a cooler (not shown) also constituting the cooling device is disposed inside the storage chamber 3. Moreover, a plurality of shelves 7 for laying thereon chemicals, and the like are extended in the storage chamber 3.

Moreover, the front face opening of the storage chamber 3 is openably closed by two sliding type doors 8, 9. In this case, the doors 8, 9 are attached between upper and lower rails 13, 14 attached to upper and lower opening edges of the insulation box 2 and extended to the left and right, and structured to move to the left and right and open/close the opening in a sliding system.

The cold air subjected to heat exchange with the cooler of the cooling device is circulated by a blower (not shown) in the storage chamber 3 closed by the doors 8, 9, and maintained in a refrigeration temperature of +2° C. to +14° C. suitable for the low-temperature insulation of chemicals, and the like.

The structure of the doors 8, 9 of the present invention will next be described with reference to FIGS. 3 to 9. Additionally, since the doors 8, 9 are symmetrical and have substantially the same structure, the same members are denoted with the same reference numerals. Specifically, each of the doors 8, 9 is constituted of a door main body 21 of a steel plate, upper and lower insulation panels 22, 23 and left and right insulation panels 24, 24 as insulation walls, a composite layer glass 26 as a transparent wall, a door inner plate 27 of a hard resin, a panel 28 also of the hard resin, and the like.

Figure 6:
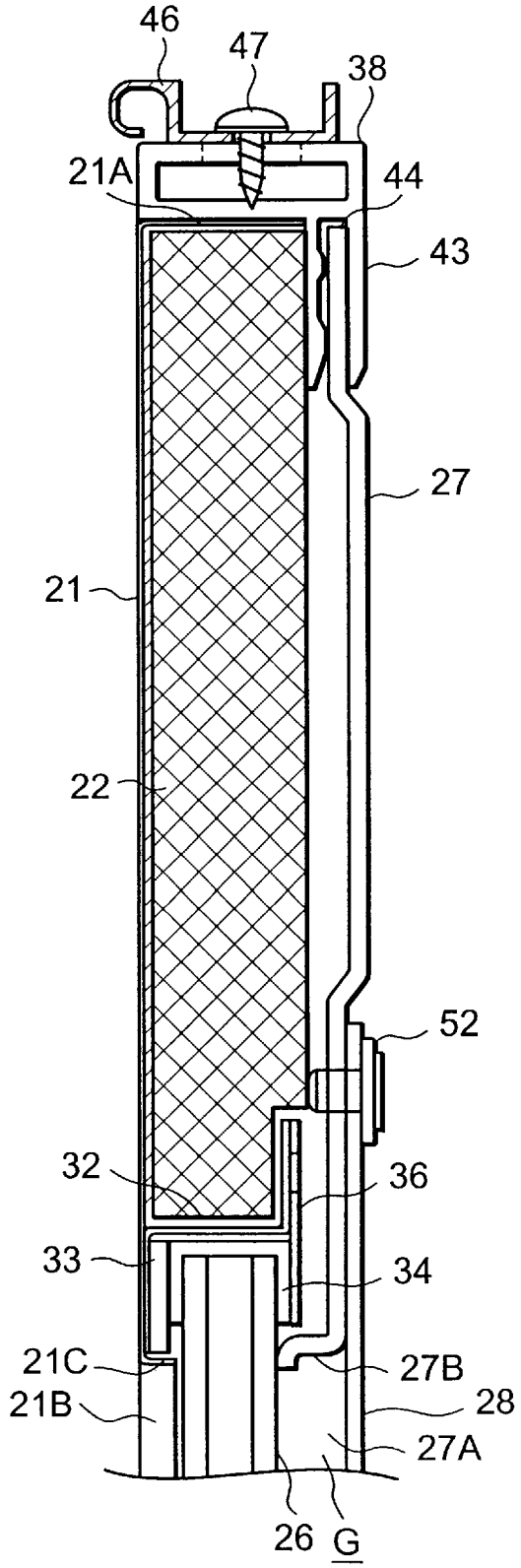
FIG. 6 is an enlarged longitudinally sectional side view showing the upper part of the door of FIG. 5.

The door main body 21 is provided with an outer flange 21A constituted by folding/bending an outer periphery rearward at right angles as shown in FIG. 6, a rectangular window hole 21B formed in a middle part, and a barring flange 21C constituted by folding/bending the periphery of the window hole 21B rearward at right angles. Moreover, a handle 29 is attached to one side of the front face of the door main body 21.

The insulation panels 22, 23, 24, 24 are bonded/fixed to a back surface surrounded by the outer flange 21A and barring flange 21C of the door main body 21 by a foam-shaped insulation adhesive sheet 31 provided with flexibility. In this case, the upper and lower insulation panels 22, 23 are positioned above and below the window hole 21B, and the left and right insulation panels 24, 24 are positioned on the left and right of the window hole 21B.

Figure 8:
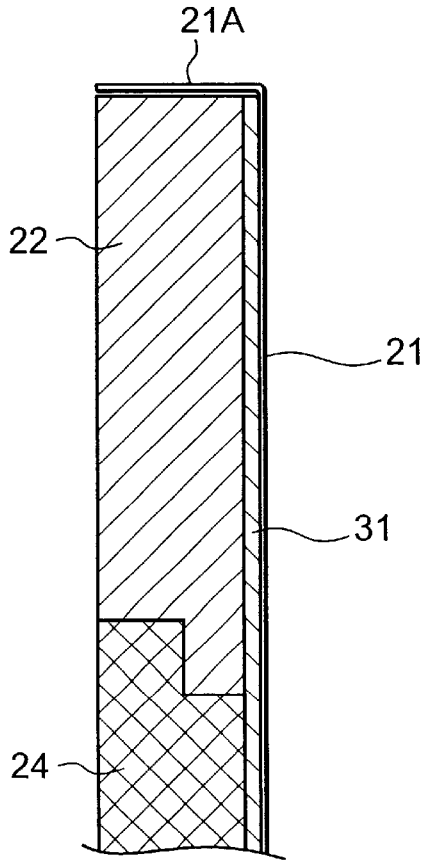
FIG. 8 is an enlarged longitudinally sectional side view showing a door main body and insulation panel.
Figure 9:
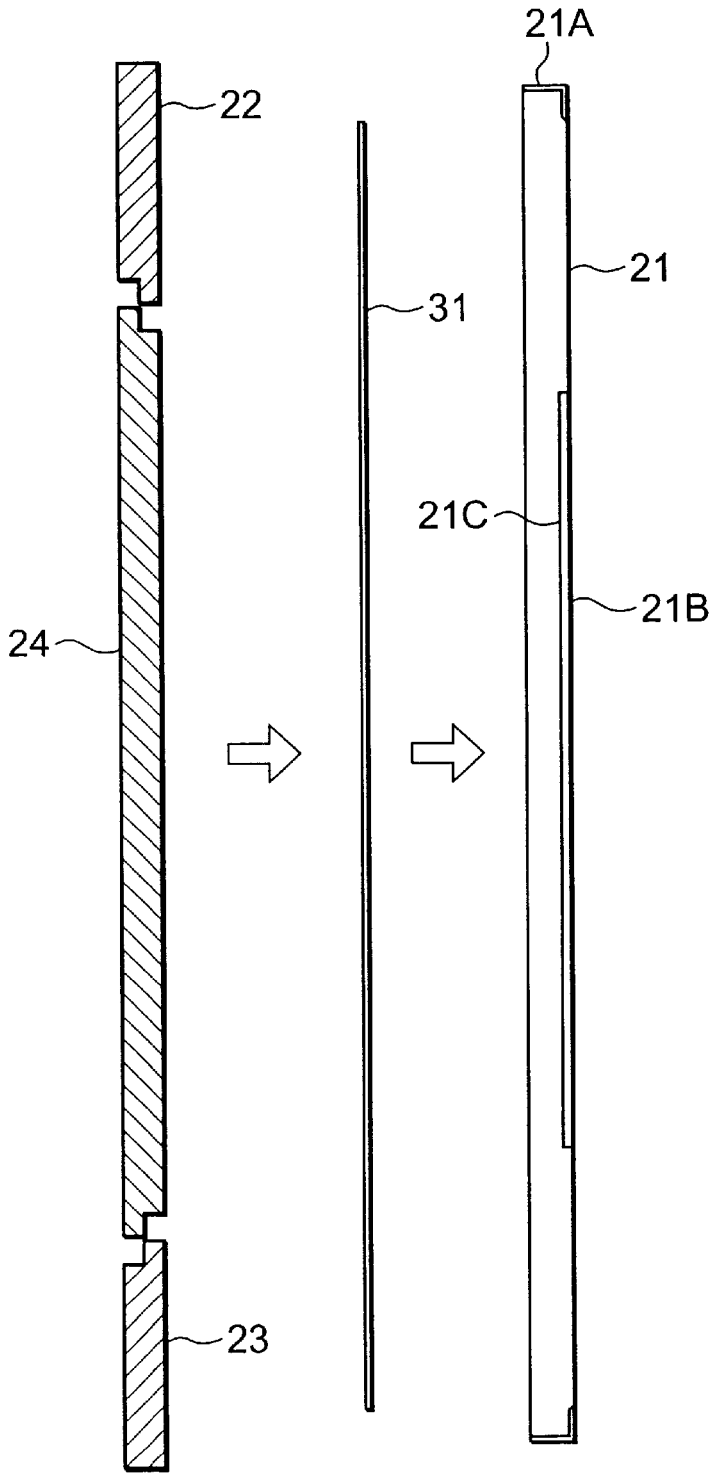
FIG. 9 is an exploded view showing the assembly procedure of the door main body and insulation panel.
Figure 10:
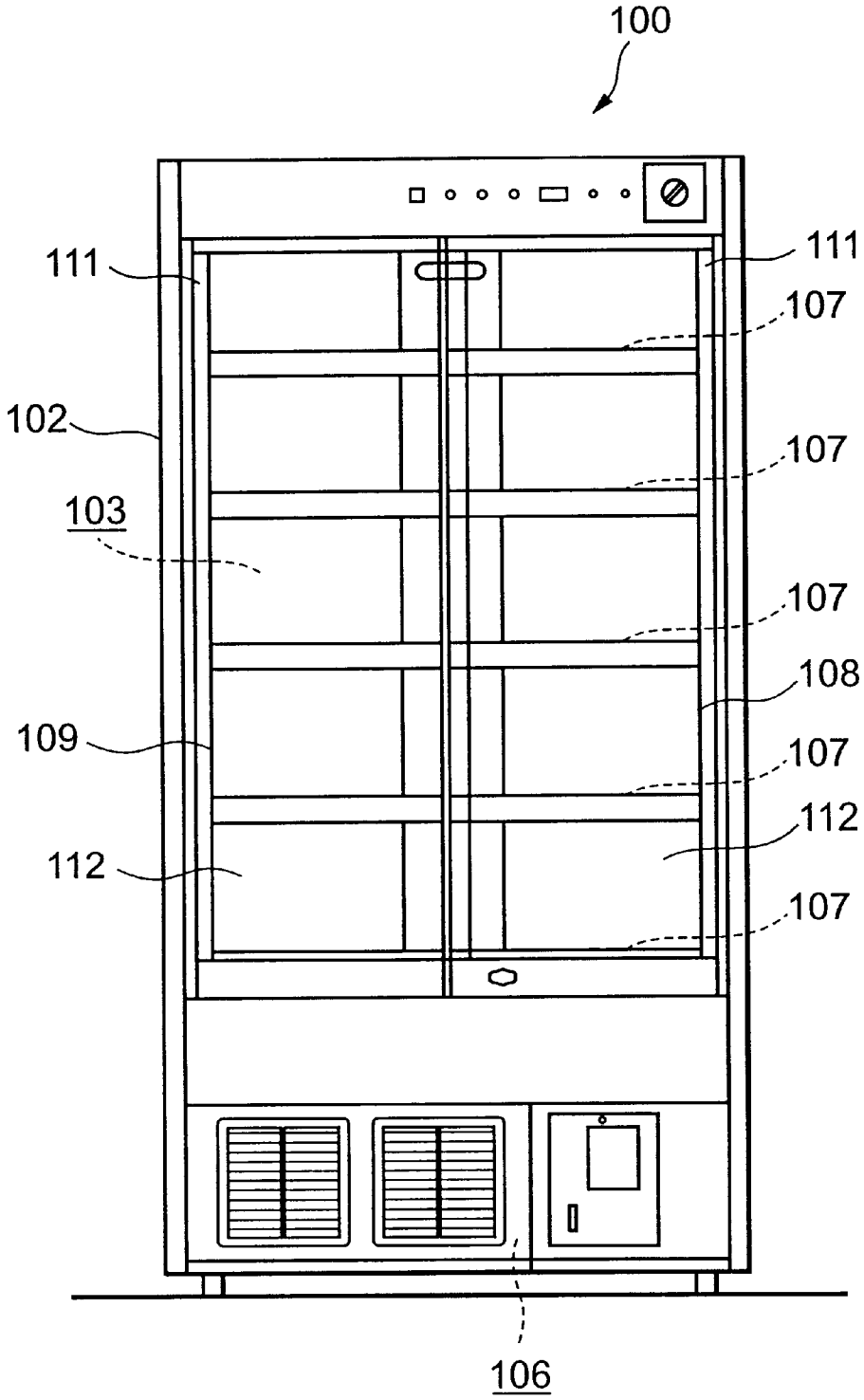
FIG. 10 is a front view of a conventional low-temperature insulating showcase.
Figure 11:
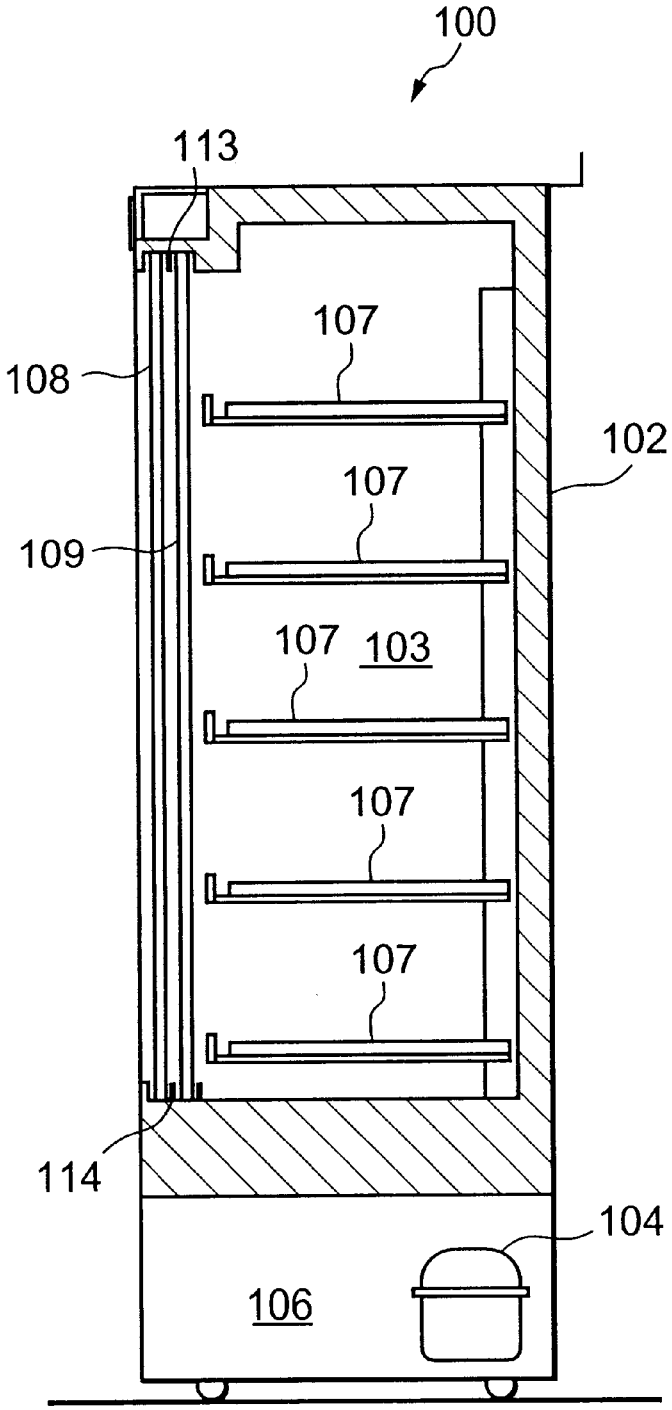
FIG. 11 is a longitudinally sectional side view e low-temperature insulating showcase of FIG. 10.

Here, each of the respective insulation panels 22, 23, 24 is a foamed polyurethane panel (slab material) molded beforehand, the lower face of the upper insulation panel 22 is molded in a staircase shape as shown in FIGS. 8, 9, and the upper face of the lower insulation panel 23 also has the staircase shape. Moreover, the upper and lower faces of the left and right insulation panels 24 are formed in the staircase shape to conform to the staircase shape of the lower or upper face of the respective insulation panels 22, 23.

Furthermore, the upper faces of the insulation panels 24, 24 are bonded to the left and right of the lower face of the insulation panel 22 by an adhesive, the lower faces of the insulation panels 24, 24 are bonded to the left and right of the upper face of the insulation panel 23 by the adhesive, and the respective insulation panels 22, 23, 24, 24 are bonded beforehand in a frame shape.

Since the bond faces of the respective insulation panels 22, 23, 24, 24 are formed in the staircase shape in this manner, the mutual bond area of the insulation panels is enlarged, and the bond strength is remarkably enhanced. This can remarkably improve the strength of the entire door in which the insulation panels are used. Particularly, the deterioration of the insulating performance in the bond part can also be minimized by lengthening the movement distance of the heat conducted in the bond face.

Subsequently, the insulation panels 22, 23, 24, 24 are fixed to the door main body 21 by placing the insulation adhesive sheet 31 (the part of the window hole 21B is cut off) with double faces used as adhesive faces to the back surface of the door main body 21 as shown in FIG. 9, and subsequently bonding the insulation panels 22, 23, 24, 24 bonded beforehand as described above to the insulation adhesive sheet 31. In this case, the strains and irregularities of the door main body 21 and insulation panels 22, 23, 24, 24 are absorbed by the insulation adhesive sheet 31, and the insulation panels 22, 23, 24, 24 are firmly fixed to the door main body 21.

Here, since the bond faces of the respective insulation panels 22, 23, 24, 24 are formed in the staircase shape as described above, the mutual bond area of the insulation panels is enlarged, and the bond strength is remarkably enhanced. This remarkably improves the strength of the entire doors 8, 9 in which the insulation panels are used. Particularly, the deterioration of the insulating performance in the bond part can also be minimized by lengthening the movement distance of the heat conducted in the bond face.

An abutment metal fixture 32 is welded/fixed beforehand to the outer periphery of the barring flange 21C of the door main body 21. This abutment metal fixture 32 is provided with a crank shape as shown in FIG. 6, the periphery of the composite layer glass 26 abuts on the abutment metal fixture 32 via a seal material 33 and cushion material 34, a press metal fixture 36 shaped like a picture frame is attached from behind and fixed to the abutment metal fixture 32 with a screw (not shown), and the composite layer glass 26 is thus engaged in the window hole 21B.

Moreover, an upper sash 38 of a hard synthetic resin is attached to the upper face of the upper outer flange 21A of the door main body 21, and a lower sash 39 of the hard synthetic resin is also attached to the lower face of the lower outer flange 21A. Furthermore, lateral sashes 41, 42 of the hard synthetic resin are attached to the outer faces of the left and right outer flanges 21A.

Inner flanges 43 extending toward the window hole 21B are formed on the rear ends of the respective sashes 38, 39, 41, 42, and engagement grooves 44 are formed in the flanges 43. Moreover, a gasket 46 is fixed to the upper face of the upper sash 38 with a screw 47, and a gasket 48 is attached to the lateral sash 41 on the side of the handle 29.

Furthermore, a soft fin 49 is integrally formed on the rear face of the opposite lateral sash 42 (in the door 8) or the back surface (in the door 9) by double extrusion molding. Moreover, rolling wheels 51 are attached to the left and right places of the lower sash 39.

The peripheral edges of the door inner plate 27 are inserted/engaged into the engagement grooves 44 of the respective sashes 38, 39, 41, 42 and held by the respective insulation panels 22, 23, 24, 24. A window hole 27A is also formed in the middle part of the door inner plate 27 as the part corresponding to the composite layer glass 26, an abutment flange 27B protruded forward is integrally formed on the periphery of the window hole 27A, and the tip end of the flange abuts on the rear face of the composite layer glass 26.

Moreover, the panel 28 is attached to the window hole 27A of the door inner plate 27 from behind, and the edge of the panel is detachably attached to the door inner plate 27 by a clip 52. When this panel 28 as a transparent hard resin plate is attached to the door inner plate 27, a predetermined air layer G is formed between the panel 28 and the composite layer glass 26.

Figure 7:
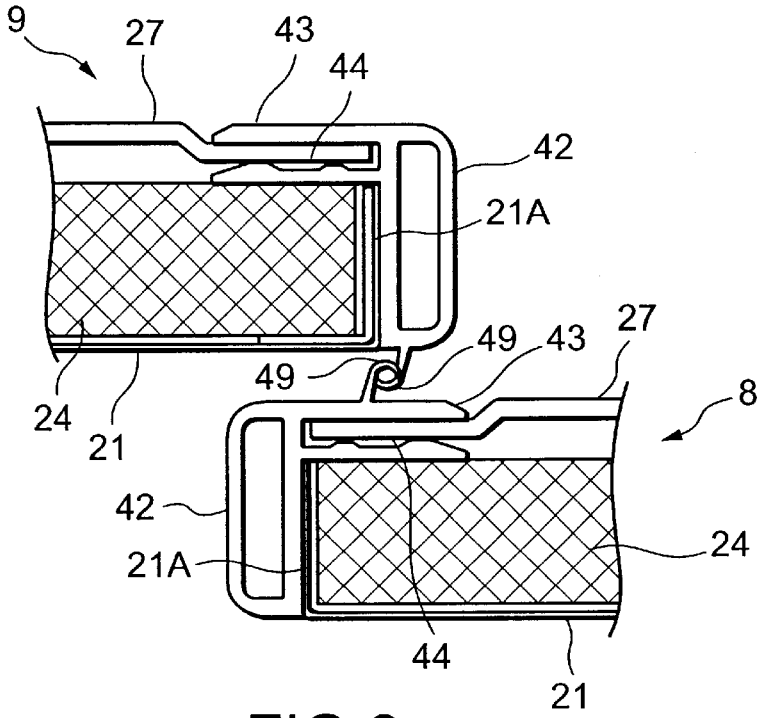
FIG. 7 is an enlarged sectional plan view-showing the middle part of the door of FIG. 3.

The doors 8 and 9 constituted in this manner are engaged in tracks before and after the upper and lower rails 13, 14, and move to the left and right to constitute the sliding type doors. In this case, the gasket 46 on the upper face abuts on the upper rail 13 to seal an opening, and the fins 49, 49 abut on each other to seal a gap between the doors 8, 9 when the doors are closed as shown in FIG. 7. Moreover, the gasket 48 on the side face also abuts on the side face of the storage chamber 3 to seal an opening.

In this state, the inside of the storage chamber 3 is visible through the composite layer glass 26 and panel 28 of the doors 8, 9, and maintained in the refrigeration temperature as described above. Moreover, the cold temperature also cools the inner faces of the doors 8, 9, but the doors 8, 9 are constituted of the insulation panels 22, 23, 24, 24 and composite layer glass 26, the proportion of the composite layer glass 26 to the entire doors 8, 9 is therefore reduced, the other part forms the insulation panels 22, 23, 24, 24, and the insulating performances of the doors 8, 9 themselves are enhanced.

Particularly, since the panel 28 is attached on the side of the storage chamber 3 of the composite layer glass 26, the air layer G between the composite layer glass 26 and the panel 28 forms an insulation space. Therefore, the insulating performances of the doors 8, 9 are further enhanced, the occurrence of dew condensation to the outer faces is effectively inhibited, and the contribution to cooling performance improvement and energy saving can also be made.

Moreover, by the presence of the panel 28 on the side of the storage chamber 3 of the composite layer glass 26, even when the chemicals contained on the shelves 7 fall toward the doors 8, 9, the chemicals collide against the panel 28. Therefore, the composite layer glass 26 is protected by the panel 28, and a disadvantage that the composite layer glass 26 breaks can also be avoided beforehand.

Furthermore, when the dangerous drugs stored in the storage chamber 3 are visible from the outside, there is a danger that robbery is caused. In this case, the transparent panel 28 is removed, and a panel 28A colored in a light screen color is attached to the door inner plate 27 with the clip 52. This sets the inside of the storage chamber 3 to be invisible, the storage chamber 3 can be used as the cold/dark chamber, and the safety can also be enhanced.

Additionally, in the embodiment, the present invention is applied to the sliding type door, but this is not limited, and the present invention is also effective for a so-called rotating door. Moreover, in the constitution of the doors 8, 9 of the embodiment the insulation panels 22, 23, 24, 24 are fixed to the door main body 21 with the adhesive sheet 31, but this is not limited, and a foamed polyurethane insulation wall may be formed by injecting and foaming a raw polyurethane liquid into the door main body 21 on the site.

POSSIBILITY OF INDUSTRIAL UTILIZATION

As described above, according to the present invention, since in the cold storage formed by openably closing the storage chamber opening constituted in the insulation box by the door, the door is constituted of the insulation wall and the see-through transparent wall, the proportion of the transparent wall to the entire door is reduced, the other part forms the insulation wall, and the insulating performance of the door itself is enhanced. Particularly, since the panel is detachably attached on the storage chamber side of the transparent wall, the insulation space is formed between the transparent wall and the panel.

Therefore, the door insulating performance is further enhanced, the occurrence of dew condensation can effectively be inhibited, and the contribution to the cooling performance improvement and energy saving can also be made. Moreover, by the presence of the panel on the storage chamber side of the transparent wall, even when the contained articles fall toward the door, the transparent wall is protected by the panel, and the breakage of the transparent wall can be avoided beforehand.

Moreover, the above-described effect can be achieved by forming the panel to be transparent without deteriorating the visibility inside the storage chamber, the storage chamber can be used as the cold/dark chamber by replacing the panel with the light screen color panel and setting the inside of the storage chamber to be invisible, and the safety can also be enhanced.

Furthermore, according to the present invention, since in the chemicals cold storage formed by openably closing the storage chamber opening constituted in the insulation box by the door, the door is constituted as the sliding type door of the insulation wall and see-through transparent wall, the proportion of the transparent wall to the entire door is reduced, the other part forms the insulation wall, and the insulating performance of the door itself is enhanced. Therefore, the occurrence of dew condensation to the door can effectively be inhibited, the contribution to the cooling performance improvement and energy saving can also be made, and the preferable showcase for the low-temperature insulation of the chemicals is formed.

Particularly, since this is achieved by the sliding type door, the door can be opened/closed without any problem even in the cold storage installation environment in which there is no space for rotating the door.

Still furthermore, according to the present invention, in addition to the above-described invention, since the insulation wall is constituted of a plurality of insulation panels fixed inside the door main body, and the bond faces of the respective insulation panels are molded in the staircase shape and mutually bonded, the mutual bond area of the insulation panels is enlarged, and the bond strength is remarkably enhanced. This can remarkably improve the strength of the entire door in which the insulation panels are used. Particularly, the deterioration of the insulating performance in the bond part can also be minimized by lengthening the movement distance of the heat conducted in the bond face.

What is claimed is:

1. A cold storage case comprising:

an insulated housing forming a storage chamber having an opening;

a door to selectively open and close said storage chamber opening, said door having an opening for a transparent see-through wall surrounded by an insulating wall formed by upper, lower and connecting side panels each molded of insulating material with the end section of each insulating panel formed with walls in a staircase shape that oppose, engage and are bonded to the walls of a mating end section of corresponding staircase shape of an adjacent insulation panel;

a plate of a hard material on the inside of said door covering said upper, lower and side panels of insulating material, and wherein at least a portion of said plate that covers said upper, lower and side panels of insulating material is spaced from the respective panel; and a transparent wall held within said door opening.

2. The cold storage case according to claim 1 wherein said transparent wall has a light screen color.

3. The cold storage case of claim 1 wherein said door is a sliding door.

4. A cold storage case as in claim 1 and further comprising an auxiliary panel detachably mounted to said plate behind and covering said transparent wall on the side of said storage chamber.

5. A cold storage case as claimed in claim 4 wherein said auxiliary panel is opaque and blocks the view through said transparent wall into the interior of the case.

6. A cold storage case as claimed in claim 4 wherein said auxiliary panel is at least partially transparent.

7. A cold storage case as claimed in claim 1 wherein a said panel is a linear piece and said end section of staircase shape comprises two walls at 90° to each other, with adjacent panels being joined at 90° to each other to provide three engaging walls for each panel where bonding takes place.

8. A cold storage case as claimed in claim 1 wherein said plate is of a hard resin material.

9. A cold storage case as in claim 8 wherein at least a portion of said plate that covers said upper, lower and side panels is spaced from the respective panel.

10. A cold storage case comprising:

an insulated housing forming a storage chamber having an opening;

a door to selectively open and close said storage chamber opening, said door having an opening for a transparent see-through wall surrounded by an insulating wall formed by upper, lower and connecting side panels each molded of insulating material with the end section of each insulating panel formed with walls in a staircase shape that oppose, engage and are bonded to the walls of a mating end section of corresponding staircase shape of an adjacent insulation panel;

a plate of a hard material on the inside of said door covering said upper, lower and side panels of insulating material;

an auxiliary panel detachably mounted to said plate behind and covering said transparent wall on the side of said storage chamber;

a transparent wall held within said door opening; and clips for detachably mounting said auxiliary panel to said plate.

* * * * *